US006644252B2

(12) United States Patent
Geyer

(10) Patent No.: US 6,644,252 B2
(45) Date of Patent: Nov. 11, 2003

(54) TWO-STROKE ENGINE WITH STORAGE DUCT

(75) Inventor: Klaus Geyer, Sulzbach (DE)

(73) Assignee: Andreas Stihl AG & Co., Waiblingen (DE)

( * ) Notice: Subject to any disclaimer, the term of this patent is extended or adjusted under 35 U.S.C. 154(b) by 0 days.

(21) Appl. No.: 10/159,837

(22) Filed: May 31, 2002

(65) Prior Publication Data

US 2002/0185088 A1 Dec. 12, 2002

(30) Foreign Application Priority Data

Jun. 11, 2001 (DE) ..... 101 28 195

(51) Int. Cl.[7] ..... F02B 33/04
(52) U.S. Cl. ..... 123/73 A; 123/73 C
(58) Field of Search ..... 123/73 A, 73 C, 123/73 PP, 73 R

(56) References Cited

U.S. PATENT DOCUMENTS 4,253,433 A 3/1981 Blair 6,216,650 B1 * 4/2001 Noguchi ..... 123/73 A

* cited by examiner

*Primary Examiner*—Noah P. Kamen
(74) *Attorney, Agent, or Firm*—Gudrun E. Huckett

(57) ABSTRACT

A two-stroke engine in a hand-held working tool such as a motor chainsaw has a combustion chamber delimited by a piston which drives a crankshaft. An outlet for removing exhaust gases from the combustion chamber and an intake for supplying fresh mixture to the combustion chamber are provided. A storage duct opens into the intake and the crankcase and is connected with a carburetor. Combustion air flows via a crankcase intake and a transfer passage into the combustion chamber. For providing good power development with good exhaust emission values under all operating conditions, the flow cross-section of the mixture-forming channel leading to the storage duct is smaller by more than one half than the flow cross-section of the intake passage leading to the crankcase intake. During idle, the fuel required for operation is supplied substantially exclusively via the mixture-forming channel leading to the storage duct.

21 Claims, 3 Drawing Sheets

TWO-STROKE ENGINE WITH STORAGE DUCT

BACKGROUND OF THE INVENTION

1. Field of the Invention

The invention relates to a two-stroke engine, in particular, as a drive motor for a hand-held working tool such as a motor chainsaw, a clearing saw, a cut-off saw or the like, comprising a combustion chamber formed in a cylinder which is delimited by a reciprocating piston, wherein the piston drives by a connecting rod a crankshaft rotatably supported in a crankcase. An outlet for removing exhaust gases from the combustion chamber and an intake supplying a fresh mixture into the combustion chamber are provided. The intake forms one end of a storage duct whose other end opens into the crankcase, wherein the storage duct between its ends is connected to a mixture-forming channel of a mixture forming device for a fuel/air mixture. The crankcase comprises a crankcase intake for combustion air and fuel, which is connected with an intake passage of an additional mixture forming device. The crankcase comprises a transfer passage to the combustion chamber which opens at one end by means of a transfer window into the combustion chamber and at the other end is connected with the crankcase.

2. Description of the Related Art

From U.S. Pat. No. 4,253,433 an internal combustion engine is known in which a mixture path of the carburetor opens into a transfer duct which is connected with one end to the combustion chamber approximately opposite the outlet and is open with its other end toward the crankcase. The crankcase has a diaphragm-controlled intake via which, in addition to combustion air, also a proportion of the fuel required for operating the internal combustion engine is to be supplied. In such arrangements, care must be taken that the fuel distribution to the crankcase intake and to the transfer duct is adjusted to the operating conditions of the internal combustion engine, respectively. This is technically complex and requires throttle members in the respective channels, wherein the throttle members are to be coupled position-dependently with one another. In practice, it was found that such internal combustion engines do not operate optimally across the entire operating range. The variable proportions of the supplied air and fuel quantities may cause disturbances particularly during acceleration from idle.

SUMMARY OF THE INVENTION

It is an object of the invention to configure a two-stroke engine of the aforementioned kind such that across the entire operating range of the internal combustion engine a good power development and a good acceleration behavior with good exhaust emission values can be reached.

The object is solved according to the invention in that the flow cross-section of the mixture-forming channel leading to the storage duct is smaller by more than one half than the flow cross-section of the intake passage leading to the crankcase intake, and that, during idle of the internal combustion engine, the fuel path opening into the crankcase intake is substantially completely closed and the fuel, required for operation, is supplied substantially exclusively via the mixture-forming channel leading to the storage duct.

This configuration provides that the flow cross-section of the mixture-forming channel leading to the storage duct is designed to be smaller by more than one half than the flow-cross section of the intake passage leading to the crankcase intake. This makes it possible that a sufficiently high flow velocity is provided in the mixture forming channel which, in principle, enables that the required fuel quantity is aspirated. Accordingly, during idle of the internal combustion engine the fuel path leading to the crankcase intake can be substantially completely blocked so that the fuel required for the operation is supplied substantially exclusively via the mixture-forming channel leading to the storage duct. It is thus ensured that during idle operation a sufficiently rich mixture is supplied to the combustion chamber which cannot lead to a significant enleanment within the combustion chamber even for air supply via the crankcase intake. Instead, in the combustion chamber a homogenous ignitable mixture is made available which ensures a smooth idle without disturbances. The mixture distribution which results during idle within the internal combustion engine favors also a powerful acceleration.

Advantageously, not only the fuel required for operation but also the combustion air required for operation is supplied exclusively via the mixture-forming channel leading to the storage duct, at least during idle of the internal combustion engine.

In practice, it was found to be expedient to supply the fuel quantity supplied to the internal combustion engine in a partial load operation and/or in the full load operation in a subordinate proportion of approximately 0% to 35% via the intake passage to the crankcase intake. This proportion serves substantially for lubricating the moving parts and has only a minimal effect on the mixture composition in the combustion chamber.

Important in connection with the constructive configuration of the mixture forming devices to the storage duct and to the crankcase intake is the ratio V of the flow cross-sections relative to one another. It should be in a range of ½ to 1/12 wherein this refers to the ratio of the flow cross-section of the first mixture-forming channel leading to the storage duct relative to the flow cross-section of the second mixture-forming channel (intake passage) leading to the crankcase intake.

The mixture-forming channel and the intake passage are positioned preferably in a common housing (carburetor housing) and form a double-flow carburetor which can be connected in a simple way to the cylinder socket of the internal combustion engine.

The fuel supply to the first mixture-forming channel and to the intake passage can be realized in many ways. Expediently, the flow cross-section of the first mixture-forming channel can be changed by a mixture-forming channel throttle, wherein then the fuel path into the mixture-forming channel is uncontrolled, i.e., the fuel supply is determined exclusively by the vacuum within the first mixture-forming channel. In the same way, the flow cross-section of the intake passage can be changeable by an intake passage throttle so that the fuel path into the intake passage is also controlled by means of vacuum.

In order to be able to achieve within the different load ranges an adjusted supply of a fuel/air mixture via the mixture-forming channel and fuel and/or combustion air via the intake passage, the throttle arranged within the first mixture-forming channel is expediently coupled position-dependently with the throttle arranged in the intake passage. The coupling is provided such that the first mixture-forming channel is open and the intake passage is closed during idle, while under full load the first mixture-forming channel is closed and the intake passage is open.

It may also be expedient to form the flow cross-section of the first mixture-forming channel and/or that of the intake passage so as to be unchangeably fixed. In this connection it is expedient to configure the fuel path to the first mixture-forming channel or to the intake passage so as to be controllable, in particular, to control it mechanically. For example, a needle valve can be arranged in the fuel path for this purpose.

BRIEF DESCRIPTION OF THE DRAWING

Further features of the invention will become apparent from the claims, the description, and the drawing in which embodiments of the invention described in detail in the following are illustrated.

It is shown in.

DESCRIPTION OF THE PREFERRED EMBODIMENTS

Figure 1:
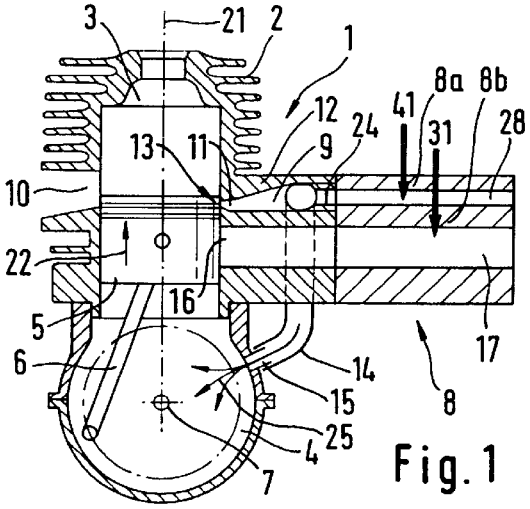
FIG. 1 in a schematic illustration a first working cycle position according to the operating principle of a two-stroke engine.

The two-stroke engine illustrated schematically in FIGS. 1 through 6 is used particularly as a drive motor in portable, hand-held working tools, for example, in motor chainsaws, clearing saws, blowers, cut-off saws or the like.

The two-stroke engine 1 is comprised substantially of a cylinder 2 and a combustion chamber 3 which is delimited by a reciprocating piston 5. The piston 5 drives by means of a connecting rod 6 a crankshaft 7 that is rotatably supported in a crankcase 4.

The exhaust gases produced in the combustion chamber 3 are removed via an outlet 10 controlled by the piston 5. In the embodiment, a cylinder intake 11 is provided which is positioned approximately opposite the outlet 10 in the cylinder wall and continues as an intake portion 9 of the cylinder connector socket 12. The cylinder intake 11 forms one end 13 of a storage duct 14 supplying fresh mixture whose other end 15 opens into the crankcase 4. Between its ends 13 and 15 the storage duct 14 communicates, expediently by means of a check valve 24, with a first mixture-forming channel 28 of a first mixture forming device 8*a*. According to a first embodiment, the mixture forming device 8*a* can be a diaphragm carburetor with a venturi.

The crankcase 4 moreover comprises an expediently piston-controlled or diaphragm-controlled crankcase intake 16 which communicates with a second mixture-forming channel in the form of an intake passage 17 of an additional mixture forming device 8*b* supplying fuel and/or combustion air. Moreover, the crankcase 4 communicates by means of a transfer passage 18 (FIG. 3) with the combustion chamber 3. For this purpose, the transfer passage 18 opens at one end with a transfer window 19 (FIG. 3) into the combustion chamber 3 and is connected via its other end 20 with the crankcase 4.

The cylinder 2 can be diecast; all openings and channels provided within the cylinder or the cylinder wall can be formed by straight slides. The outlet 10, the intake portion 9, and the crankcase intake 16 are in the form of channel portions aligned substantially radially to the cylinder axis 21, but they can also be positioned angularly.

The cylinder intake 11 of the storage duct 14 into the combustion chamber 3 is positioned in the case of piston control in the vertical direction 22 of the piston 5 above the crankcase intake 16. In this connection, the storage duct 14 is formed substantially as an outer component of the two-stroke engine 1. In the case of a diaphragm-controlled crankcase intake 16, a different position may be advantageous also.

In the illustrated embodiment, the outlet 10, the intake cylinder intake 11, and the crankcase intake 16 are controlled by the piston 5, i.e., they are piston-controlled. The connection between the first mixture forming device 8*a* and the storage duct 14 is realized by means of a check valve 24 which is embodied as a diaphragm valve in the shown embodiment; piston control may be advantageous.

Figure 2:
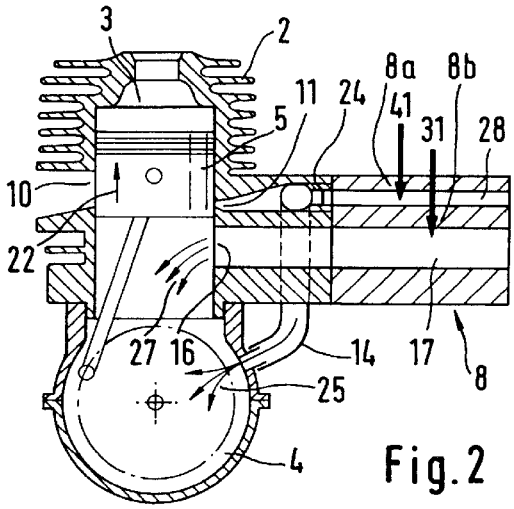
FIG. 2 in a schematic illustration a second working cycle position according to the operating principle of a two-stroke engine.

In FIG. 1, the piston 5 moves upwardly in the stroke direction 22 wherein the vacuum present with in the crankcase 4 effects aspiration of a rich fuel/air mixture through the open check valve 24. The rich mixture flows into the storage duct 14. The configuration can be such that for a nominal rpm (engine speed) and full load so much mixture is aspirated into the storage duct 14 that a proportion of advantageously approximately 0% to 35%, preferably approximately 10%, of the mixture is transferred into the crankcase 4 and, in this way, contributes to the lubrication of moving parts. This partial transfer of the aspirated rich mixture is indicated in FIG. 1 by arrows 25. When the piston 5 moves in the stroke direction 22 father toward the upper dead center, the crankcase intake 16 is also opened (FIG. 2). Via the intake passage 17 additional fuel/air mixture or pure combustion air flows into the crankcase 4 from the additional mixture forming device 8*b*.

Figure 3:
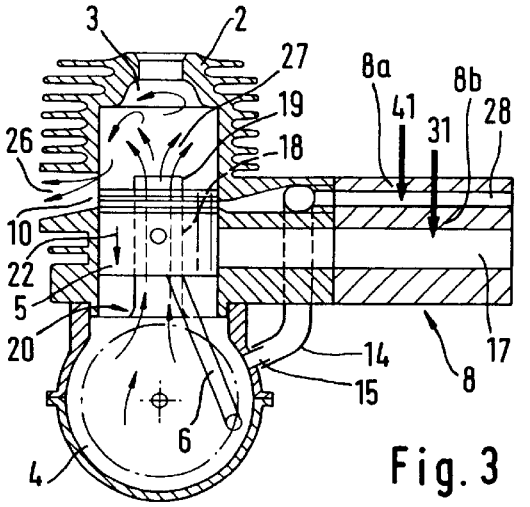
FIG. 3 in a schematic illustration a third working cycle position according to the operating principle of a two-stroke engine.
Figure 4:
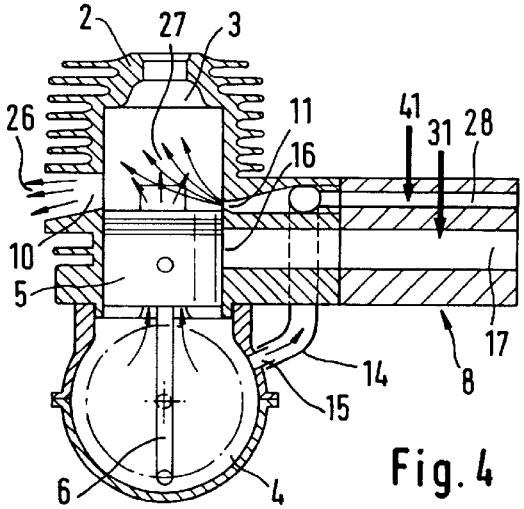
FIG. 4 in a schematic illustration a fourth working cycle position according to the operating principle of a two-stroke engine.
Figure 5:
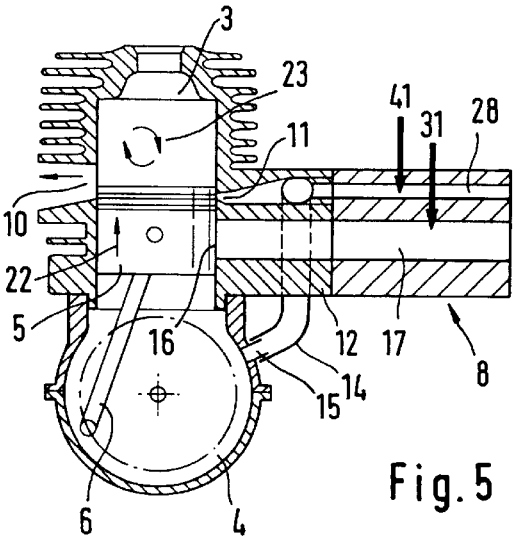
FIG. 5 in a schematic illustration a fifth working cycle position according to the operating principle of a two-stroke engine.
Figure 6:
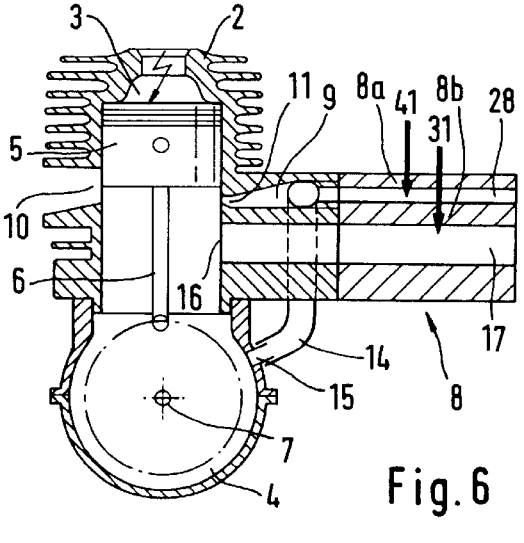
FIG. 6 in a schematic illustration a sixth working cycle position according to the operating principle of a two-stroke engine.

The outlet 10 is closed and the compressed mixture present within the combustion chamber 3 is ignited near the upper dead center of the piston 5. The piston 5 moves, as illustrated in FIG. 3, through the upper dead center and then moves in the stroke direction 22 downwardly, wherein first the outlet 10 is opened so that the exhaust gases 26 of the combustion can flow out. Shortly after, or even simultaneously with, the opening of the outlet 10, the transfer window 19 is opened so that the volume of mixture or of combustion air 27, which has been intermediately stored in the crankcase 4, enters the combustion chamber 3 and displaces the exhaust gases toward the outlet 10. After almost complete relief of the combustion chamber 3 the cylinder intake 11 of the storage duct 14 is also opened. As a result of the piston 5 having moved downwardly in the stroke direction 22, the crankcase volume is greatly compressed in the vicinity of the lower dead center (FIG. 4); upon opening of the cylinder intake 11, the rich mixture, which has been intermediately stored in the storage duct 14, is pushed into the combustion chamber 3 within a short period of time as a result of the high pressure within the crankcase 4. A return flow to the mixture forming device 8*a* is prevented by the closed check valve 24.

Proportions of the combustion air 27 having entered the combustion chamber from the crankcase form substantially the scavenging losses; moreover, the rich mixture entering via the cylinder intake 11 is shielded relative to the outlet 10 by the combustion air that has entered earlier. As a result of the flows present within the combustion chamber 3, the layered charge is greatly swirled and forms a homogenous mixture 23 upon further compression by means of the piston (FIG. 5) now moving upwardly in the stroke direction 22. By means of the piston 5 moving upwardly in the stroke direction 22, aspiration and storing of a rich mixture in the storage duct 14 for the subsequent working cycle take place again, as has been explained in connection with FIG. 1. Near the upper dead center (FIG. 6), ignition takes place anew in the combustion chamber 3; the working cycle now starts over again.

Figure 7:
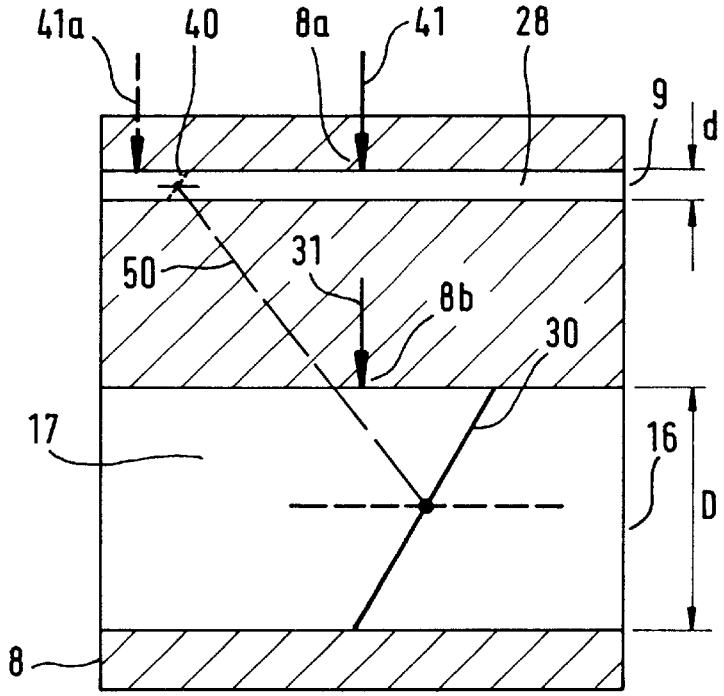
FIG. 7 in a schematic illustration a section of a double-flow carburetor for operating the internal combustion engine according to FIGS. 1 to 6.

According to the present invention, it is provided that the flow cross-section d of the mixture-forming channel 28 leading to the storage duct 14 is smaller by more than one half than the flow cross-section D of the second mixture-forming channel (intake passage) 17 leading to the crankcase intake 16. In this connection it is provided that, during idle of the internal combustion engine, the intake passage 17 leading to the crankcase intake 16 is substantially completely closed and the fuel required for operation and the combustion air required for operation are supplied substantially exclusively via the mixture-forming channel 28 leading to the storage duct 14. In this way, the intake passage 17 to the crankcase intake 16 can be substantially completely closed during idle by means of a throttle blade 30 pivotable about a shaft, as illustrated in FIG. 7. When the throttle blade 30 is completely closed, no fuel will flow via the fuel path 31 to the intake passage 17. Neither combustion air nor fuel is supplied to the crankcase intake 16.

A throttle blade 40 can also be arranged in the first mixture-forming channel 28 which during idle is preferably completely open. During idle, the throttle blade 30 of the intake passage 17 is closed. Via the fuel path 41 fuel is taken in as a result of the vacuum present within the mixture-forming channel 28 so that substantially the entire air and the entire fuel required for operation of the internal combustion engine in the idle situation are supplied via the intake portion 9 to the storage duct 14. It may be expedient to provide the fuel path 41 downstream of the throttle member 40 and an additional fuel path 41 a upstream of the throttle member which, for example, is active during partial load operation and full load operation and can be embodied as a carburetor, in particular, a diaphragm carburetor. The throttle blades 30 and 40, for example, are coupled with one another by a linkage 50 wherein the fuel path 41 opens downstream of the throttle blade 40 into the mixture-forming channel 28 and is expediently controlled by vacuum. Accordingly, the fuel path 41 can be formed by a carburetor such as a diaphragm carburetor. The fuel path 31 opening into the intake passage 17 is positioned upstream of the throttle blade 30.

During idle, the mixture-forming channel 28 is open and the intake passage 17 is throttled, while in the full load situation the mixture-forming channel 28 is throttled and the intake passage 17 is open. Since the fuel path 41 is positioned downstream of the throttle blade 40, a significant quantity of fuel is conveyed in the full load situation through the mixture-forming channel 28 into the storage duct.

It may be advantageous in the partial load operation and/or in the full load operation to supply via the fuel path 31 a subordinate proportion of fuel via the intake passage 17 to the crankcase intake 16. In an expedient embodiment, the proportion is approximately in the range of 0% to 35% of the entire amount of fuel needed for the operation of the internal combustion engine.

For the distribution of the fuel—in the idle situation exclusively via the mixture path 28; in the partial load situation and full load situation expediently a proportion via the intake passage 17—and the required combustion air it is expedient when the ratio V=d/D of the flow cross-section d of the first mixture-forming channel 28 leading to the storage duct 14 relative to the flow cross-section D of the intake passage 17 leading to the crankcase intake 16 is within a range of ½ to 1/12.

Figure 8:
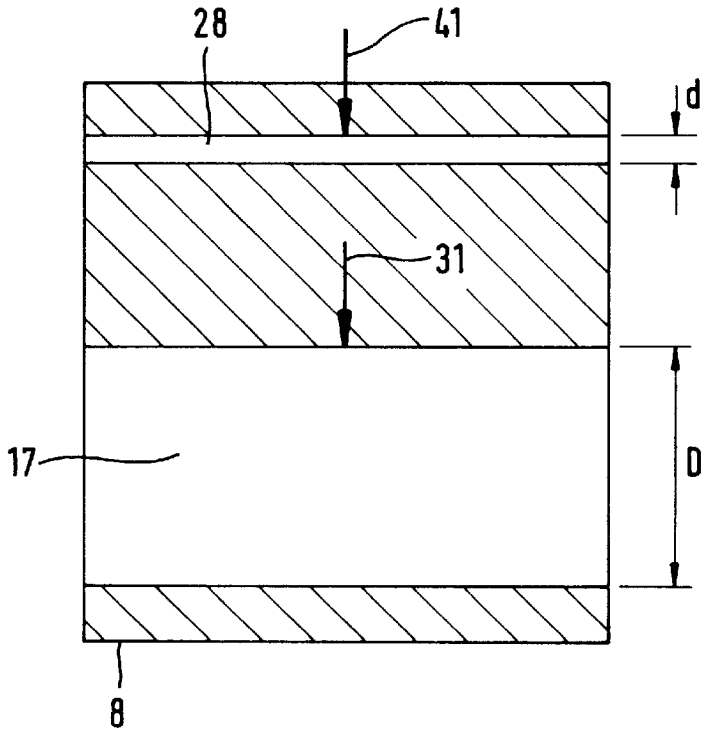
FIG. 8 in a schematic illustration a section of a double-flow carburetor according to FIG. 7 with mixture-forming channel and intake passage that are unchangeable with regard to their flow cross-section.
Figure 9:
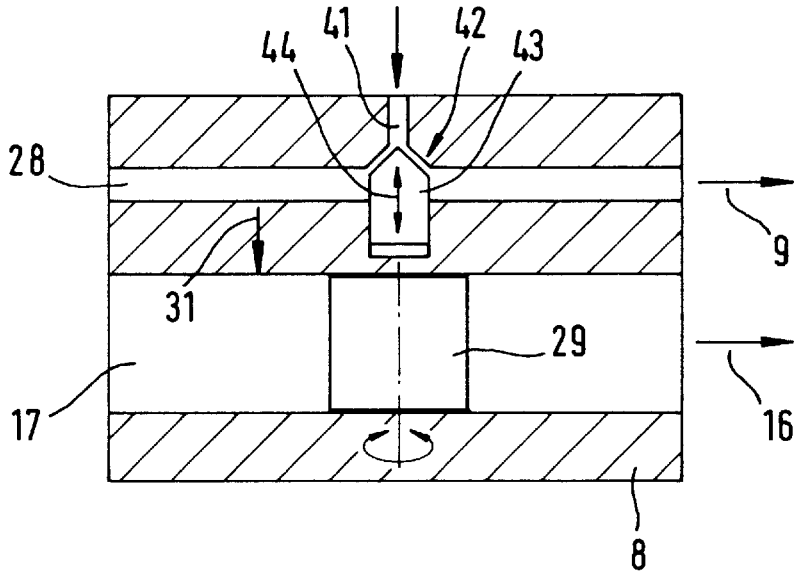
FIG. 9 in a schematic illustration a double-flow carburetor in a view corresponding to FIG. 7 with controlled fuel supply in the mixture-forming channel and an intake passage that can be throttled.

In the embodiment according to FIG. 8, throttle members are not arranged in the two channels 17 and 28. While in FIG. 7 a mixture-forming channel throttle 40 is arranged in the mixture-forming channel 28 and an intake passage throttle 30 is arranged in the intake passage 17, in the embodiment according to FIG. 8 the flow cross-section of the mixture-forming channel 28 and/or the flow cross-section of the intake passage 17 are configured to be unchangeable. For controlling the mixture, the fuel path 41 to the mixture-forming channel 28 and the fuel path 31 to the intake passage 17 can be controlled, in particular, mechanically controlled. Accordingly, the fuel can be conveyed via a valve 42, expediently, a needle valve 43, as illustrated in FIG. 9. In this connection, the fuel path 41 is mechanically controlled by the needle valve 43; the needle valve, as a function of the desired fuel supply, is opened or closed in the adjusting direction 44.

In FIG. 9, it is alternatively provided to configure the fuel path 31 so as to be uncontrolled so that the fuel supply is exclusively realized via the pressure conditions in the intake passage 17. For throttling the intake passage 17 to the crankcase intake 16, a throttle in the form of a rotary sleeve valve 29 can be provided which can be adjusted about a rotary axis positioned transversely to the intake passage 17.

Figure 10:
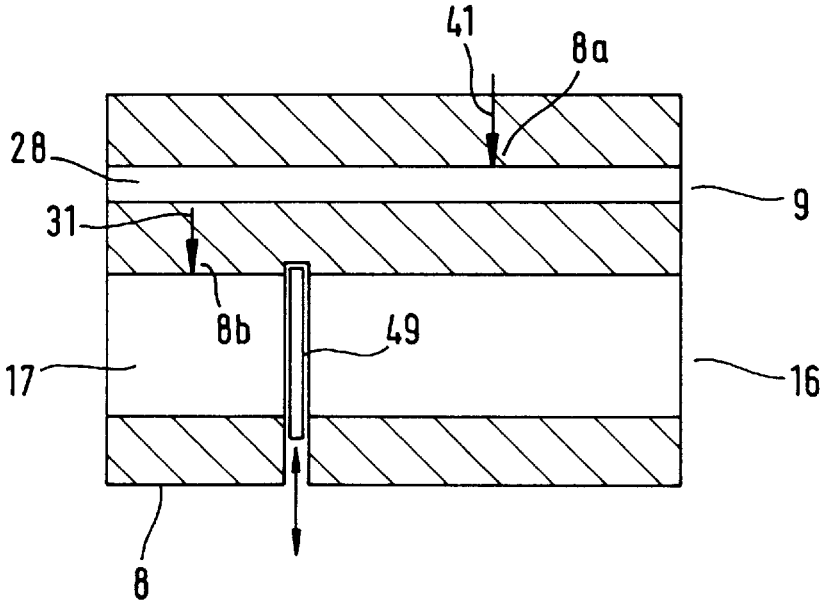
FIG. 10 a view of a further embodiment of a double-flow carburetor with a mixture-forming channel with an unchangeable cross-section and an intake passage that can be throttled.

In the embodiment according to FIG. 10 the intake passage 17 is to be throttled by a slide 49, while the mixture-forming channel 28 is free of throttling devices and thus has a substantially unchangeable flow cross-section. In the mixture-forming channel 28 the fuel supply is realized by vacuum via the fuel path 41. Such a mixture forming device 8*a* is preferably embodied as a diaphragm carburetor.

In the same way, the mixture forming device 8*b* can have a diaphragm carburetor upstream of the intake passage throttle 49 in the fuel path 31 to the intake passage 17 so that, as a function of the vacuum present within the intake passage 17, fuel is supplied to the crankcase intake 16.

The mixture forming channel 28 and the intake passage 17 are preferably arranged in a housing of a double-flow carburetor 8, wherein the two channels 17 and 28 are positioned substantially parallel to one another. Such a double-flow carburetor can be connected without great expenditure with the cylinder connecting socket 12 of the internal combustion engine 1 when the mixture intake 16 in the stroke direction 22 of the internal combustion engine is positioned below the cylinder intake 11 for the fresh mixture.

While specific embodiments of the invention have been shown and described in detail to illustrate the inventive principles, it will be understood that the invention may be embodied otherwise without departing from such principles.

What is claimed is:

1. A two-stroke engine as a drive motor in a hand-held working tool, the two-stroke engine comprising:

a cylinder (2) and a reciprocating piston (5) arranged in the cylinder (2), wherein the reciprocating piston (5) delimits a combustion chamber (3) within the cylinder (2);

a crankshaft (7) rotatably supported in a crankcase (4);

a connecting rod (6) connected to the reciprocating piston (5) and the crankshaft (7), wherein the piston (5) drives the crankshaft (7) via the connecting rod (6);

wherein the cylinder (2) has an outlet (10) for removing exhaust gases from the combustion chamber (3) and a cylinder intake (11) supplying a fresh mixture into the combustion chamber (3);

a storage duct (14) having a first end (13) formed by the cylinder intake (11) and having a second end (15) opening into the crankcase (4);

a first mixture forming device (8*a*) for forming a fuel/air mixture having a first mixture-forming channel (28);

a second mixture forming device (8*b*) having a second mixture-forming channel (17);

wherein the first mixture-forming channel (28) is connected to the storage duct (14) between the first and second ends (13, 15);

wherein the crankcase (4) comprises a crankcase intake (16), connected to the second mixture-forming channel (17), for taking in combustion air and fuel;

a first fuel path (41) opening into the first mixture-forming channel (28) and a second fuel path (31) opening into the second mixture-forming channel (17);

a transfer passage (18) having a first end, connected to the combustion chamber (3) and having a transfer window (19) opening into the combustion chamber (3), and a second end (20) connected to the crankcase (4);

wherein the first mixture-forming channel (28) leading to the storage duct (14) has a flow cross-section (d) that is smaller by more than one half than a flow cross-section (D) of the second mixture-forming channel (17) leading to the crankcase intake (16); and wherein, during idle of the internal combustion engine (1), the second fuel path (31) opening into the second mixture-forming channel (17) is substantially completely closed and fuel, required for operation, is supplied substantially exclusively via the first mixture-forming channel (28) leading to the storage duct (14).

2. The two-stroke engine according to claim 1, wherein, during idle of the internal combustion engine (1), combustion air is supplied substantially exclusively via the first mixture-forming channel (28) while the crankcase intake (16) is substantially closed.

3. The two-stroke engine according to claim 1, wherein, at least in one of partial load operation and full load operation, fuel supplied to the internal combustion engine (1) is supplied in a subordinate proportion via the second mixture-forming channel (17) and the crankcase intake (16).

4. The two-stroke engine according to claim 3, wherein fuel supplied to the combustion engine (1) is supplied in a proportion of approximately 0% to 35% via the second mixture-forming channel (17) and the crankcase intake (16).

5. The two-stroke engine according to claim 1, wherein the ratio (V=d/D) of the flow cross-section (d) of the first mixture-forming channel (28) leading to the storage duct (14) relative to the flow cross-section (D) of the second mixture-forming channel (17) leading to the crankcase intake (16) is in a range of ½ to 1/12.

6. The two-stroke engine according to claim 1, wherein the first mixture-forming channel (28) has a mixture-forming channel throttle (40) configured to change the flow cross-section (d) of the first mixture-forming channel (28).

7. The two-stroke engine according to claim 6, wherein the second mixture-forming channel (17) has an intake passage throttle (29, 30, 49) configured to change the flow cross-section (D).

8. The two-stroke engine according to claim 7, wherein the mixture-forming channel throttle (40) and the intake passage throttle (29, 30, 49) are coupled position-dependently with one another.

9. The two-stroke engine according to claim 8, wherein the mixture-forming channel throttle (40) and the intake passage throttle (29, 30, 49) are coupled with opposite orientation such that the first mixture-forming channel (28) is open and the second mixture-forming channel (17) is closed during idle and the mixture-forming channel (28) is throttled and the second mixture-forming channel (17) is open under full load operation.

10. The two-stroke engine according to claim 9, wherein the mixture-forming channel throttle (40) and the intake passage throttle (29, 30, 49) are selected from the group consisting of a throttle blade (30, 40), a rotary sleeve valve (29), and a throttle slide (49).

11. The two-stroke engine according to claim 1, wherein the flow cross-section (d) of the first mixture-forming channel (28) is unchangeably fixed.

12. The two-stroke engine according to claim 1, wherein the flow cross-section (D) of the second mixture-forming channel (17) is unchangeably fixed.

13. The two-stroke engine according to claim 1, wherein one of the first and second fuel paths (341, 41) is a controllable fuel path.

14. The two-stroke engine according to claim 1, wherein the controllable fuel path (41) is mechanically controllable.

15. The two-stroke engine according to claim 14, wherein the controllable fuel path comprises a valve (42).

16. The two-stroke engine according to claim 15, wherein the valve is a needle valve (43).

17. The two-stroke engine according to claim 1, wherein the first and second mixture-forming channels (17, 28) are configured to aspirate fuel by vacuum.

18. The two-stroke engine according to claim 1, wherein the first and second mixture-forming channels (17, 28) are arranged in a common carburetor housing.

19. The two-stroke engine according to claim 18, wherein the first and second mixture-forming channels (17, 28) extend substantially parallel.

20. The two-stroke engine according to claim 19, wherein the first and second mixture-forming channels (17, 28) are preferably positioned atop one another in a direction of a longitudinal cylinder axis (21) of the cylinder (2).

21. The two-stroke engine according to claim 20, wherein the first mixture-forming channel (28) is connected by a check valve (24) with the storage duct (14).

* * * * *